US006453524B1

(12) United States Patent
Liu

(10) Patent No.: US 6,453,524 B1
(45) Date of Patent: Sep. 24, 2002

(54) SHOE LACE DEVICE THAT CAN BE TIGHTENED TO SIMULATE A DOUBLE-BOW KNOT

(76) Inventor: Kun-Chung Liu, No. 5, Alley 9, Lane 212, San-Feng Rd., Hou-Li Hsiang, Taichung Hsien (TW)

( * ) Notice: Subject to any disclaimer, the term of this patent is extended or adjusted under 35 U.S.C. 154(b) by 0 days.

(21) Appl. No.: 09/920,856

(22) Filed: Aug. 3, 2001

(51) Int. Cl.[7] ..... A43C 7/00
(52) U.S. Cl. ..... 24/712.5; 24/115 G
(58) Field of Search ..... 24/712–712.9, 24/115 G; 36/50.1

(56) References Cited

U.S. PATENT DOCUMENTS 743,924 A * 11/1903 Pratt
2,893,090 A * 7/1959 Pagoda
3,065,512 A * 11/1962 Pagoda
3,701,572 A * 10/1972 Velasquez
4,342,557 A * 8/1982 Bandar
5,065,482 A * 11/1991 Lofy
6,237,252 B1 * 5/2001 Cook

FOREIGN PATENT DOCUMENTS

WO WO 98/47401 * 10/1998

* cited by examiner

*Primary Examiner*—James R. Brittain
(74) *Attorney, Agent, or Firm*—Foley & Lardner

(57) ABSTRACT

A shoe lace device for a shoe includes first to ninth lace portions, a clamp member, and a cord unit. Lower ends of the first to sixth lace portions are anchored on the eyelet tabs. Upper ends of the first and second lace portions and those of the seventh and eighth lace portions are interconnected to form first and second loops, respectively. The upper ends of the third and ninth lace portions serve as distal lace segments. The clamp member is sleeved slidably on medial sections of the first to third lace portions. The cord unit is secured on and is disposed externally of the clamp member between the first and second loops, and cooperates with the loops and the distal lace segments to simulate a double-bow configuration.

10 Claims, 7 Drawing Sheets

SHOE LACE DEVICE THAT CAN BE TIGHTENED TO SIMULATE A DOUBLE-BOW KNOT

BACKGROUND OF THE INVENTION

1. Field of the Invention

The invention relates to a shoe lace device, more particularly to a shoe lace device that can be tightened to simulate a double-bow knot.

2. Description of the Related Art

Referring to FIG. 1, a conventional shoe lace device 1 of a shoe 4 includes a shoe lace 2 having first and second lace sections 201, 202, and a clamp member 3. The first lace section 201 is strung on a shoe body 41 so as to form a criss-cross pattern on eyelet tabs 5 of the shoe body 41. The second lace section 202 is formed as a simple loop, and has lower ends 2021 connected to the first lace section 201, thereby anchoring the lower ends 2021 on the eyelet tabs 5, respectively. The clamp member 3, as shown in FIG. 2, includes an elongate casing 301, a clamping block 302, and a spring member 303. The elongate casing 301 is formed with a lateral open end 3010 for receiving the clamping block 302, a closed end 3011 opposite to the open end 3010, and a vertically extending hole unit 301' for extension of the lower ends 2021 of the second lace section 202 therethrough. The clamping block 302 is slidably received in the open end 3010 of the casing 301, and is formed with a vertically extending slot unit 3021 that corresponds to the hole unit 301' of the casing 301 for extension of the lower ends 2021 of the second lace section 202 therethrough. The spring member 303 is disposed in the casing 301, and has opposite ends that abut respectively against the clamping block 302 and the closed end 3011 of the casing 301. As such, the clamping block 302 is biased by the spring member 303 so as to misalign the slot unit 3021 from the hole unit 301' in order to clamp the second lace section 202 between the clamping block 302 and the casing 301.

To tighten the shoe 4, the clamp member 3 is forced to move downwardly along the second lace section 202, thereby bringing the lower ends 2021 of the second lace section 202 closer together.

To loosen the shoe 4, the clamping block 302 is operated to align the slot unit 3021 with the hole unit 301' against action of the spring member 303, and the clamp member 3 is then moved upwardly along the second lace section 202, thus permitting the lower ends 2021 of the second lace section 202 to move away from each.

Although the aforesaid shoe 4 has a shoe lace device 1 that is easy to use, the simple loop configuration of the second lace section 202 has an unattractive appearance.

SUMMARY OF THE INVENTION

Therefore, the main object of the present invention is to provide a shoe lace device that can be tightened to simulate a double-bow knot.

Accordingly, a shoe lace device of this invention is adapted for use with a shoe having first and second eyelet tabs. The shoe lace device comprises first, second, third, fourth, fifth, sixth, seventh, eighth and ninth lace portions, a clamp member, and a cord unit. Each of the first to ninth lace portions has a lower end and an upper end. The lower ends of the first, second and third lace portions are adapted to be anchored on the first eyelet tab. The lower ends of the fourth, fifth and sixth lace portions are adapted to be anchored on the second eyelet tab. The upper ends of the first and second lace portions are interconnected to form a first loop. The upper ends of the seventh and eighth lace portions are interconnected to form a second loop. The upper ends of the third and ninth lace portions serve as distal lace segments. The clamp member is sleeved slidably on medial sections of the first, second and third lace portions. The upper ends of the fourth, fifth and sixth lace portions, and the lower ends of the seventh, eighth and ninth lace portions are anchored on the clamp member. The cord unit is secured on and is disposed externally of the clamp member between the first and second loops, and cooperates with the first and second loops and the distal lace segments to simulate a double-bow configuration.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
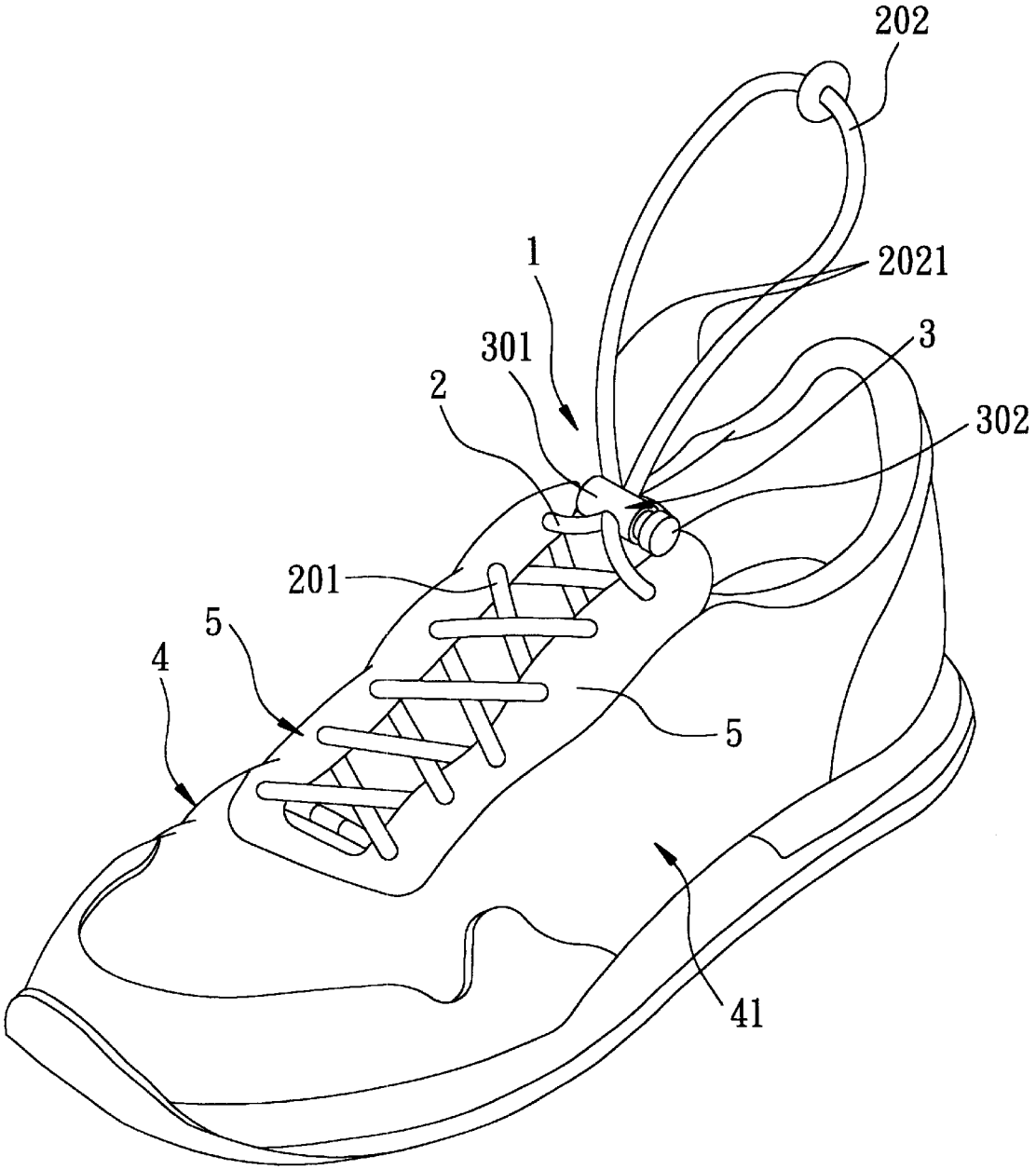
FIG. 1 PRIOR ART
FIG. 1 is a perspective view of a shoe with a conventional shoe lace device.
Figure 2:
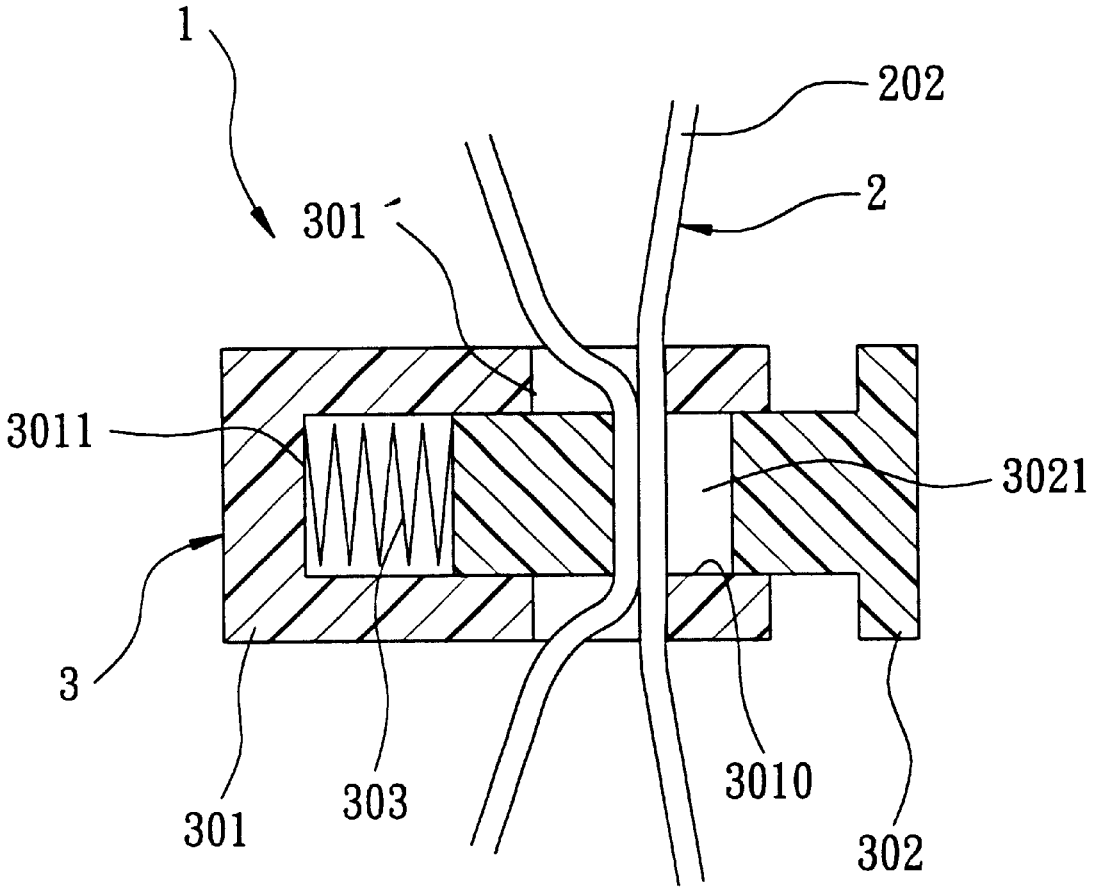
FIG. 2 PRIOR ART
FIG. 2 is a cross-sectional view of a clamp member of the conventional shoe lace device.
Figure 3:
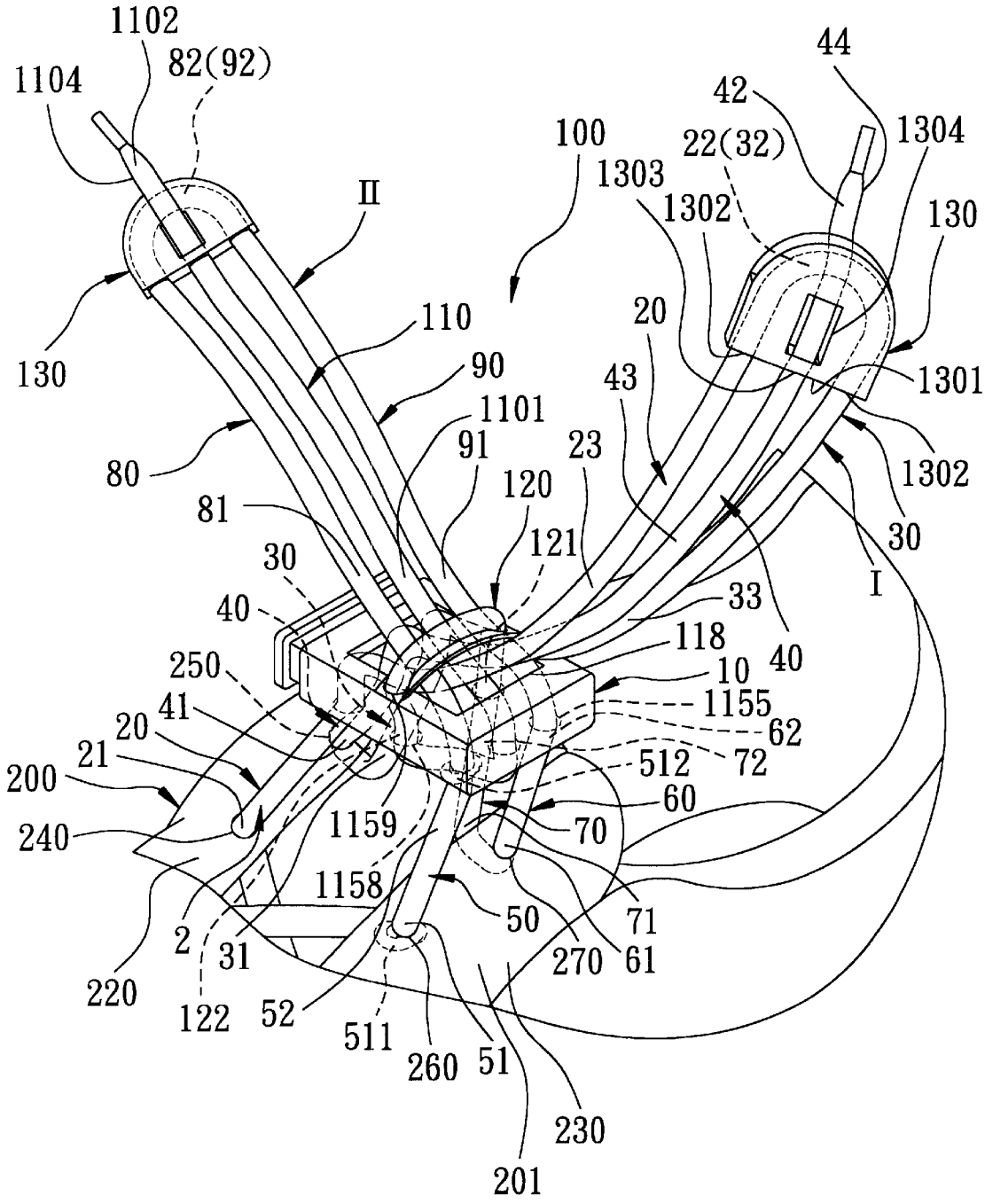
FIG. 3 is a fragmentary perspective view illustrating the preferred embodiment of a shoe lace device according to the present invention.

Referring to FIG. 3, the preferred embodiment of a shoe lace device 100 according to the present invention is shown to be adapted for use with a shoe 200 having first and second eyelet tabs 220, 230. The shoe lace device 100 comprises a shoe lace 2, a clamp member 10, a cord unit 120, and a pair of pull plates 130. The shoe lace 20 has a first lace segment that is strung on a shoe body 201 in a conventional manner so as to form a criss-cross pattern on the eyelet tabs 220, 230, and a second lace segment that includes first, second, third, fourth, fifth, sixth, seventh, eighth and ninth lace portions 20, 30, 40, 50, 60, 70, 80, 90, 110. Each of the first to ninth lace portions 20, 30, 40, 50, 60, 70, 80, 90, 110 has a lower end 21, 31, 41, 51, 61, 71, 81, 91, 1101 and an upper end 22, 32, 42, 52, 62, 72, 82, 92, 1102. The lower end 21 of the first lace portion 20 is connected to the first lace segment, and is adapted to be anchored on a first eyelet 240 of the first eyelet tab 220. The lower ends 31, 41 of the second and third lace portions 30, 40 are adapted to be anchored on a second eyelet 250 of the first eyelet tab 220. The lower end 51 of the fourth lace portion 50 is formed with a knot 511 that is connected to the first lace segment, and that is adapted to engage a first eyelet 260 of the second eyelet tab 230. The lower ends 61, 71 of the fifth and sixth lace portions 60, 70 are adapted to be anchored on a second eyelet 270 of the second eyelet tab 230. The lower end 31 of the second lace portion 30 is connected to the lower end 41 of the third lace portion 40, whereas the lower end 61 of the fifth lace portion 60 is connected to the lower end 71 of the sixth lace portion 70. The upper ends 22, 32 of the first and second lace portions 20, 30 are interconnected to form a first loop (I). The upper ends 82, 92 of the seventh and eighth lace portions 80, 90 are interconnected to form a second loop (II). The upper ends 42, 1102 of the third and ninth lace portions 40, 110 serve as distal lace segments 44, 1104. Furthermore, the upper ends 22, 32, 42 of the first, second and third lace portions 20, 30, 40 are interleaved with the seventh, eighth and ninth lace portions 80, 90, 110.

Figure 4:
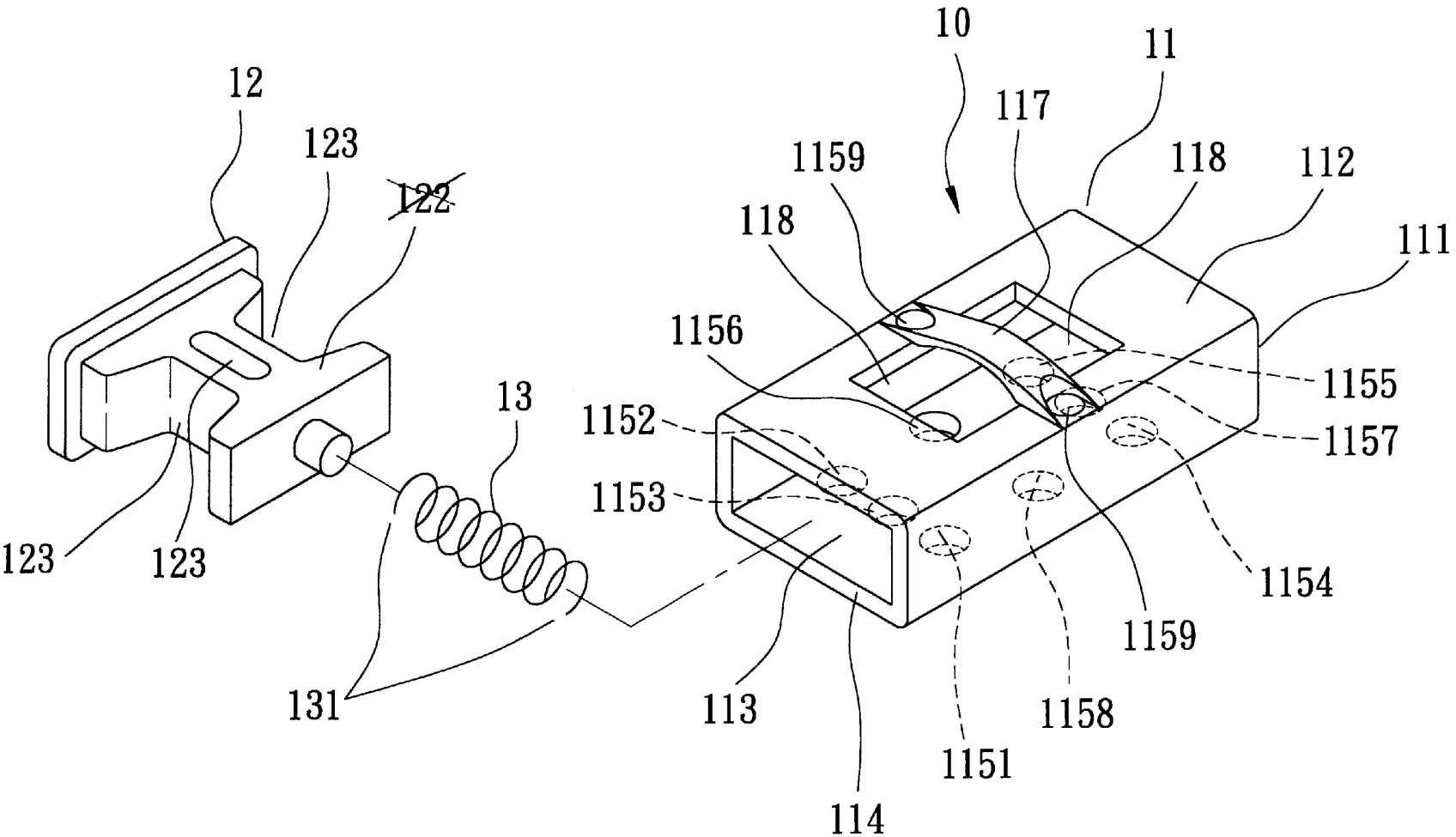
FIG. 4 is an exploded perspective view of a clamp member of the shoe lace device of FIG. 3.
Figure 5:
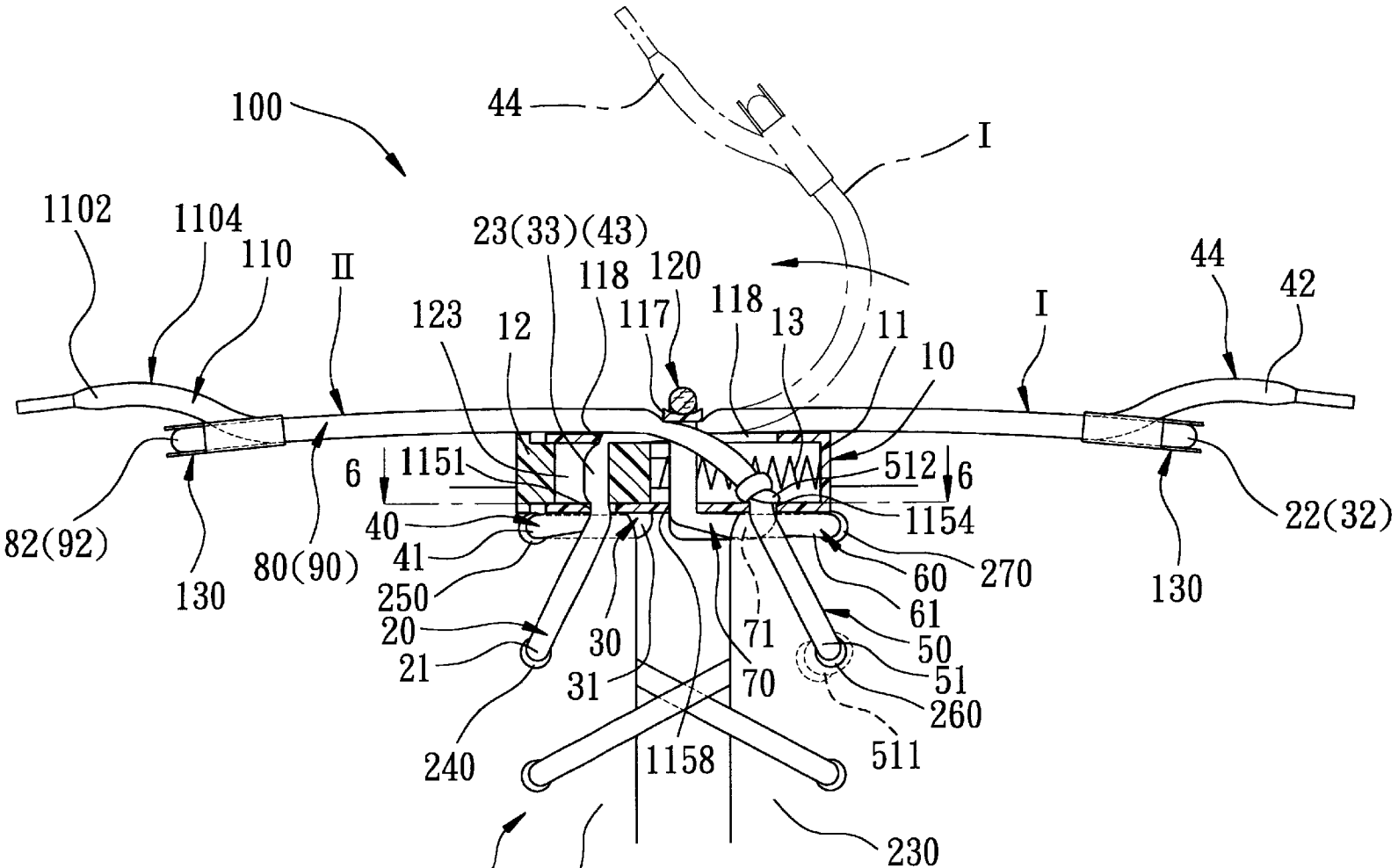
FIG. 5 is a fragmentary cross-sectional view illustrating how the shoe is tightened by the preferred embodiment.
Figure 6:
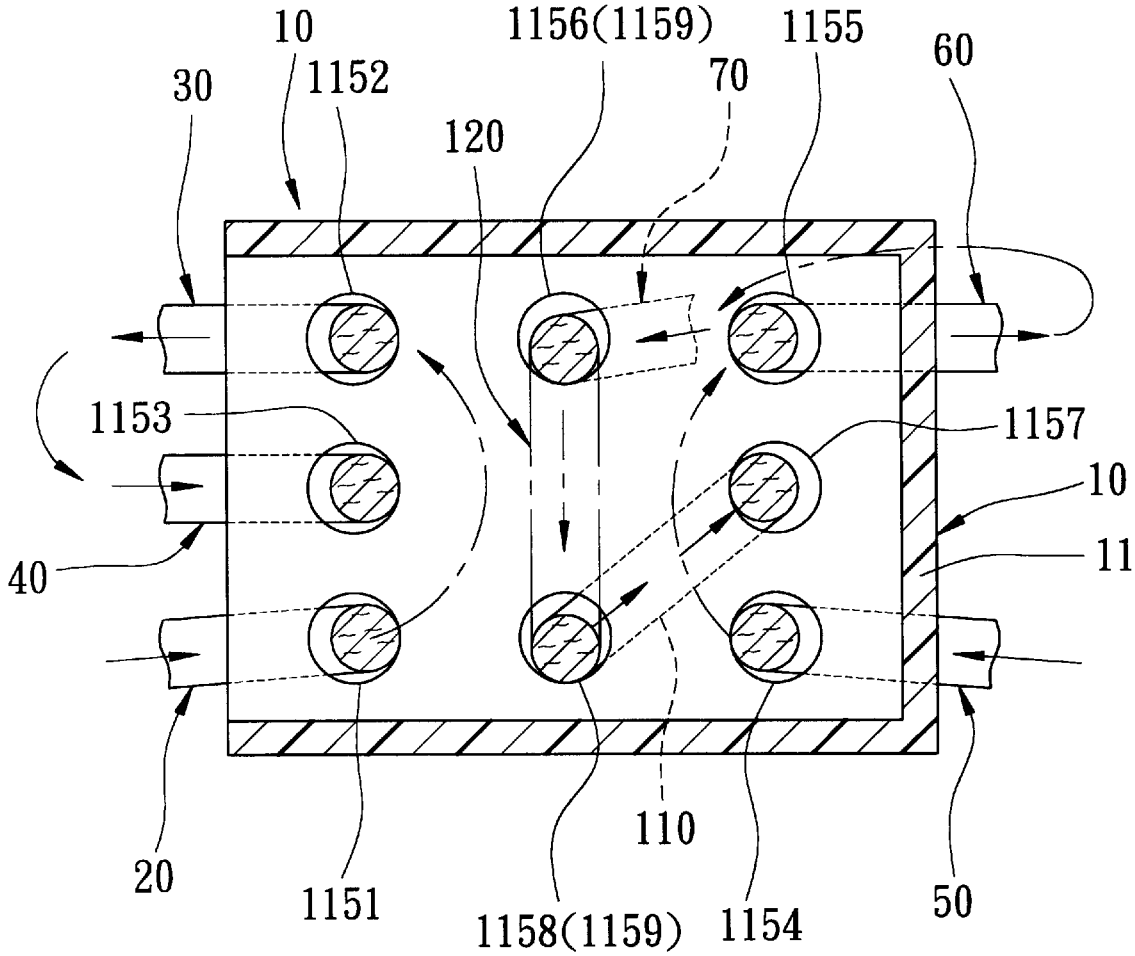
FIG. 6 is a fragmentary partly sectional schematic view of the clamp member illustrating how lace portions pass through lace holes of the clamp member.

With further reference to FIGS. 4, 5 and 6, the clamp member 10 is sleeved slidably on medial sections 23, 33, 43 of the first, second and third lace portions 20, 30, 40, and includes an elongate casing 11, a clamping block 12, and a biasing member 13. The elongate casing 11 has a lateral open end portion 113, and a closed end portion 111 opposite to the open end portion 113, and includes a lower base plate 114, and an upper cover plate 112 opposite to the lower base plate 114. The lower base plate 114 is formed with first, second, third, fourth, fifth, sixth, seventh, and eighth lace holes 1151, 1152, 1153, 1154, 1155, 1156, 1157, 1158. The upper cover plate 112 is formed with an aperture 118, and has a positioning rib 117 that extends across the aperture 118 and that is formed with a pair of ninth lace holes 1159. The medial sections 23, 33, 43 of the first, second, and third lace portions 20, 30, 40 extend respectively through the first, second and third lace holes 1151, 1152, 1153 and the aperture 118. The upper end 52 of the fourth lace portion 50 extends through the fourth lace hole 1154, and is formed with a knot 512 disposed in and engaging the lower base plate 114, thereby anchoring the upper end 52 of the fourth lace portion 50 on the clamp member 10. The knots 511, 512 on the lower and upper ends 51, 52 of the fourth lace portion 50 cooperate to limit a maximum distance of the clamp member 10 from the second eyelet tab 230. The upper ends 62, 72 of the fifth and sixth lace portions 60, 70 extend respectively through the fifth and sixth lace holes 1155, 1156. The lower ends 81, 91 of the seventh and eighth lace portions 80, 90 extend through the aperture 118 and are connected respectively to the upper ends 52, 62 of the fourth and fifth lace portions 50, 60, thereby anchoring the lower ends 81, 91 of the seventh and eighth lace portions 80, 90 and the upper ends 52, 62 of the fourth and fifth lace portions 50, 60 on the clamp member 10. The lower end 1101 of the ninth lace portion 110 extends through the aperture 118 to the seventh lace hole 1157.

The clamping block 12 is slidably received in the open end portion 113 of the casing 11, and is formed with a vertically extending slot unit 123 that corresponds to the first, second and third lace holes 1151, 1152, 1153 in the casing 11 for extension of the medial sections 23, 33, 43 of the first, second and third lace portions 20, 30, 40 therethrough.

The biasing member 13 is disposed in the casing 11, has opposite ends 131 that abut respectively against the clamping block 12 and the closed end portion 111 of the casing 11, and biases the clamping block 12 outwardly of the open end portion 113 of the casing 11, thereby clamping the medial sections 23, 33, 43 of the first, second and third lace portions 20, 30, 40 between the clamping block 12 and the casing 11.

The cord unit 120 is disposed above the positioning rib 117 of the upper cover plate 112, and has first and second retaining legs 121, 122. The first retaining leg 121 extends through one of the ninth lace holes 1159 to connect with the upper end 72 of the sixth lace portion 70 at the sixth lace hole 1156, thereby anchoring the upper end 72 of the sixth lace portion 70 on the clamp member 10. The second retaining leg 122 extends through the other of the ninth lace holes 1159 and through the eighth lace hole 1158 to connect with the lower end 1101 of the ninth lace portion 110 at the seventh lace hole 1157, thereby anchoring the lower end 1101 of the ninth lace portion 110 on the clamp member 10 and securing the cord unit 120 on and externally of the clamp member 10 between the first and second loops (I), (II). The cord unit 120 cooperates with the first and second loops (I), (II) and the distal lace segments 44, 1104 to simulate a double-bow configuration.

Each of the pull plates 130 is connected to the upper ends 22, 32, 42, 82, 92, 1102 of a respective set of the first, second and third lace portions 20, 30, 40, and the seventh, eighth and ninth lace portions 80, 90, 110, has an end wall 1301, and is formed with a U-shaped first passage with two first openings 1302 formed in the end wall 1301, a second passage with a second opening 1303 formed in the end wall 1301 and disposed between the first openings 1302, and an access hole 1304 that communicates with the second opening 1303 of the second passage. The upper ends 22, 32, 82, 92 of the respective set of the first and second lace portions 20, 30 and the seventh and eighth lace portions 80, 90 extend into the first passage via the first openings 1302. The upper end 42, 1102 of the respective one of the third and ninth lace portions 40, 110 extends into the second passage via the second opening 1303 and through the access hole 1304.

Figure 7:
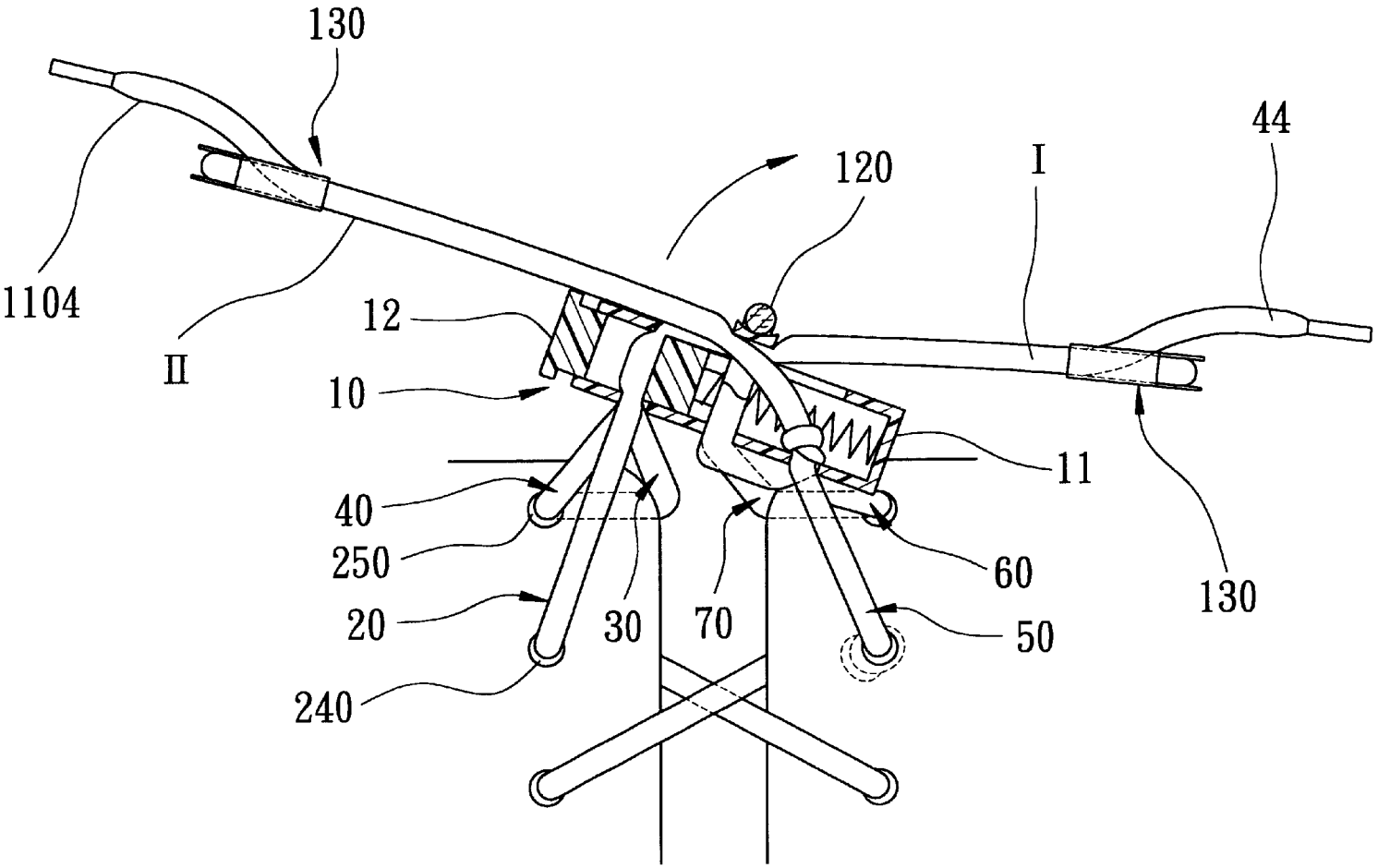
FIG. 7 is a fragmentary perspective view illustrating how operation of the clamp member permits loosening of the shoe.

In use, when the first loop (I) is pulled toward the positioning rib 117, the clamp member 10 will be pushed to slide downwardly along the medial sections 23, 33, 43 of the first, second and third lace portions 20, 30, 40 to bring the lower ends 21, 31, 41, 51, 61, 71 of the first to sixth lace portions 20, 30, 40, 50, 60, 70 and thus the first and second eyelet tabs 220, 230 closer together for tightening the shoe 200, as best illustrated in FIG. 5. To loosen the shoe 200, the clamping block 12 is operated to compress the biasing member 13, thereby aligning the slot unit 123 with the first, second and third lace holes 1151, 1152, 1153 of the casing 11. At this time, the clamp member 10 can be slid upwardly along the medial sections 23, 33, 43 of the first, second and third lace portions 20, 30, 40, thereby permitting the lower ends 21, 31, 41, 51, 61, 71 of the first to sixth lace portions 20, 30, 40, 50, 60, 70 to move away from each other for loosening the shoe 200, as best shown in FIG. 7.

Therefore, the shoe 200 is not only easy to wear and remove, but also has an attractive appearance in view of the double-bow configuration of the shoe lace device 100.

It should be noted that the eyelets 240, 260, 250, 270 through which the first and fourth lace portions 20, 50 and the second and fifth lace portions 30, 60 extend can be formed to be spaced farther apart, so that the lengths of the fourth, fifth and sixth lace portions 50, 60, 70 can be increased, thereby allowing greater movement of the clamp member 10 to facilitate the easy wearing and removal of the shoe 200. Alternatively, a pair of hitch members (not shown) could be used instead of the eyelets 260, 270 to anchor removably the lower ends 51, 61, 71 of the fourth, fifth and sixth lace portions 50, 60, 70 onto the eyelet tab 230 of the shoe 200 to facilitate easy wearing and removal of the shoe 200.

While the present invention has been described in connection with what is considered the most practical and preferred embodiments, it is understood that this invention is not limited to the disclosed embodiment but is intended to cover various arrangements included within the spirit and scope of the broadest interpretation so as to encompass all such modifications and equivalent arrangements.

I claim:

1. A shoe lace device for a shoe having first and second eyelet tabs, said shoe lace device comprising:

first, second, third, fourth, fifth, sixth, seventh, eighth and ninth lace portions, each of which has a lower end and an upper end, said lower ends of said first, second and third lace portions being adapted to be anchored on the first eyelet tab;

said lower ends of said fourth, fifth and sixth lace portions being adapted to be anchored on the second eyelet tab;

said upper ends of said first and second lace portions being interconnected to form a first loop;

said upper ends of said seventh and eighth lace portions being interconnected to form a second loop;

said upper ends of said third and ninth lace portions serving as distal lace segments;

a clamp member sleeved slidably on medial sections of said first, second and third lace portions;

said upper ends of said fourth, fifth and sixth lace portions, and said lower ends of said seventh, eighth and ninth lace portions being anchored on said clamp member; and a cord unit secured on and disposed externally of said clamp member, said cord unit being disposed between said first and second loops, and cooperating with said first and second loops and said distal lace segments to simulate a double-bow configuration.

2. The shoe lace device of claim 1, wherein said lower end of said fourth lace portion is formed with a knot that is adapted to engage the second eyelet tab.

3. The shoe lace device of claim 1, wherein said lower end of said second lace portion is connected to said lower end of said third lace portion, and said lower end of said fifth lace portion is connected to said lower end of said sixth lace portion.

4. The shoe lace device of claim 1, further comprising a pair of pull plates, each of which is connected to said upper ends of a respective set of said first, second and third lace portions, and said seventh, eighth and ninth lace portions.

5. The shoe lace device of claim 4, wherein each of said pull plates has an end wall, and is formed with a U-shaped first passage with two first openings formed in said end wall, a second passage with a second opening formed in said end wall and disposed between said first openings, and an access hole communicated with said second passage, said upper ends of the respective set of said first and second lace portions and said seventh and eighth lace portions extending into said first passage via said first openings, said upper end of the respective one of said third and ninth lace portions extending into said second passage via said second opening and through said access hole.

6. The shoe lace device of claim 1, wherein said clamp member includes:

an elongate casing with a lateral open end portion, and a closed end portion opposite to said open end portion, said casing including a lower base plate, and an upper cover plate opposite to said lower base plate, said upper cover plate being formed with an aperture, said lower base plate being formed with first, second and third lace holes, said medial sections of said first, second, and third lace portions extending respectively through said first, second and third lace holes and said aperture;

a clamping block slidably received in said open end portion of said casing, and formed with a vertically extending slot unit that corresponds to said first, second and third lace holes in said casing for extension of said medial sections of said first, second and third lace portions therethrough; and a biasing member disposed in said casing and having opposite ends that abut respectively against said clamping block and said closed end portion of said casing for biasing said clamping block outwardly of said open end portion of said casing, thereby clamping said medial sections of said first, second and third lace portions between said clamping block and said casing.

7. The shoe lace device of claim 6, wherein said lower base plate is further formed with fourth, fifth, sixth, and seventh lace holes, said upper ends of said fourth, fifth and sixth lace portions extending respectively through said fourth, fifth, and sixth lace holes, said lower ends of said seventh and eighth lace portions extending through said aperture and being connected respectively to said upper ends of said fourth and fifth lace portions, said lower end of said ninth lace portion extending through said aperture to said seventh lace hole, said cord unit having first and second retaining legs connected respectively to said upper end of said sixth lace portion and said lower end of said ninth lace portion at said sixth and seventh lace holes, respectively.

8. The shoe lace device of claim 7, wherein said upper end of said fourth lace portion is formed with a knot disposed in and engaging said lower base plate.

9. The shoe lace device of claim 7, wherein:

said lower base plate further has an eighth lace hole;

said upper cover plate having a positioning rib that extends across said aperture and that is formed with a pair of ninth lace holes;

said cord unit being disposed above said upper cover plate, said first retaining leg extending through one of said ninth lace holes to connect with said upper end of said sixth lace portion, said second retaining leg extending through the other of said ninth lace holes and through said eighth lace hole to connect with said lower end of said ninth lace portion.

10. The shoe lace device of claim 1, wherein said upper ends of said first, second and third lace portions are interleaved with said seventh, eighth and ninth lace portions.

* * * * *